US006290428B1

(12) United States Patent
Hall et al.

(10) Patent No.: US 6,290,428 B1
(45) Date of Patent: Sep. 18, 2001

(54) MACHINE AND METHOD FOR DISPENSING A SEALING COMPOUND

(76) Inventors: Allen M. Hall, 306 Hawthorne Rd., Linthicum, MD (US) 21090; Craig A. Hall, 1607 Petes Crt., Crofton, MD (US) 21114; Steven M. Hall, 7482 Wigley Ave., Jessup, MD (US) 20794

( * ) Notice: Subject to any disclaimer, the term of this patent is extended or adjusted under 35 U.S.C. 154(b) by 0 days.

(21) Appl. No.: 09/400,827

(22) Filed: Sep. 21, 1999

(51) Int. Cl.[7] ..... E01C 23/02; B67D 5/00

(52) U.S. Cl. ..... 404/75; 404/107; 404/111; 222/1; 222/82; 222/88; 15/103.5; 15/257.05

(58) Field of Search ..... 404/72, 74, 75, 404/87, 92, 107, 108, 111; 222/1, 81, 82, 88, 89, 191, 628; 15/103.5, 257.05, 300.1; 118/72, 109, 266, 267

(56) References Cited

U.S. PATENT DOCUMENTS

| | | | | |
|---|---|---|---|---|
| 1,698,015 | * | 1/1929 | Fitzgerald | 404/107 |
| 1,750,104 | * | 3/1930 | Heltzel | 404/107 |
| 1,924,636 | * | 8/1933 | Burket | 404/107 |
| 2,578,080 | * | 12/1951 | Middlestadt | 404/111 |
| 2,733,836 | * | 2/1956 | Switzer | 222/82 |
| 2,989,769 | | 6/1961 | Houser . | |
| 3,567,123 | | 3/1971 | Mitchell . | |
| 3,703,856 | * | 11/1972 | Wikel et al. | 404/107 |
| 3,873,227 | | 3/1975 | Goethe et al. . | |
| 3,989,403 | | 11/1976 | Verive . | |
| 3,991,912 | * | 11/1976 | Soto | 222/89 |
| 4,175,885 | | 11/1979 | Jeppson . | |
| 4,423,980 | | 1/1984 | Warnock . | |
| 4,511,284 | * | 4/1985 | Sterner | 404/111 |
| 4,575,279 | | 3/1986 | Mateja . | |
| 4,630,965 | * | 12/1986 | Nguyen et al. | 404/107 |
| 4,653,424 | | 3/1987 | Schloss et al. . | |
| 4,676,557 | | 6/1987 | Shope et al. . | |
| 4,732,109 | | 3/1988 | Selby . | |
| 4,767,234 | * | 8/1988 | Rizzo | 404/111 |
| 4,831,958 | | 5/1989 | Selby . | |
| 5,184,757 | * | 2/1993 | Giannuzzi | 222/82 |
| 5,325,994 | | 7/1994 | Mizialko et al. . | |
| 5,330,074 | * | 7/1994 | Wirsig et al. | 222/82 |
| 5,366,309 | | 11/1994 | Springall . | |
| 5,735,952 | | 4/1998 | Wilson, Sr. . | |
| 5,855,298 | * | 1/1999 | Teetsel, III et al. | 222/81 |
| 5,971,207 | * | 10/1999 | McDonough et al. | 222/1 |
| 6,012,649 | * | 1/2000 | Riddell et al. | 239/307 |
| 6,102,615 | * | 8/2000 | Wilson, Sr. | 404/111 |

* cited by examiner

*Primary Examiner*—Thomas B. Will
*Assistant Examiner*—Gary S. Hartmann
(74) *Attorney, Agent, or Firm*—Rosenberg, Klein & Lee

(57) ABSTRACT

A machine for dispensing a sealing compound to an area of application and a method of sealing cracks in pavement is provided. The machine includes a frame structure, a disposable container removably mounted to the frame structure, a discharge tube member rupturing the opening in the bottom of the container, and a controllable valve in the discharge tube member to control the flow of the sealing compound from the disposable container to the area of the application. The frame structure may support a blower to clean the crack and supports a squeegee member mounted to a box member into which the sealing compound is received from the discharge tube member, to evenly spread the sealing compound within the crack and in the nearmost areas.

4 Claims, 4 Drawing Sheets

MACHINE AND METHOD FOR DISPENSING A SEALING COMPOUND

FIELD OF THE INVENTION

The present invention relates to an apparatus and technique for applying protective coating to pavement, and more particularly, to a self-contained lightweight portable machine for filling cracks in pavement by use of a sealing compound.

More particularly, the present invention relates to a machine and method for dispensing a sealing compound using a disposable standard bucket mounted on a frame structure of the machine containing the sealing compound. The sealing compound is prefilled within the bucket and once the sealing compound has been consumed during the sealing operation, the bucket is disposed of and discarded. A next standard bucket with prefilled sealing compound is then mounted onto the machine in order to continue the process of filling cracks in pavement. Through use of a simple lever and cutting member located on the sealing machine, the prefilled sealing compound is operationally activated.

Further, the present invention relates to a machine for dispensing a sealing compound into cracks in pavement to be filled which may be provided with a blower for cleaning debris, leaves and dirt from the crack to be filled prior to application of the sealing compound. In this manner, a relatively clear crack area is provided which permits a more effective laying down of the sealing compound and maintains a seal structure compound which has a longer life than previously known prior art systems and methods.

BACKGROUND OF THE INVENTION

The importance of maintaining the surface of highways, driveways, parking lots, and airports in structurally enhanced conditions cannot be over-estimated. The dependency of both industry and individuals on the high structural quality of pavement surfaces is highly significant. Surface failures may become a serious problem if not maintained properly. When asphalt is laid down as a new product or as an overlay, it immediately begins to deteriorate under the influence of the external environment, load of trucks, cars, airplanes, various construction, underground water, temperature changes, and other conditions relating to weather.

Eventually, if the pavement is not cared for properly, it will be undermined, forming cracks of different sizes resulting in structural failure. It is important to maintain the asphalt in a condition where no or as little as possible undermining water is allowed below the asphalt or into the subsurface in order to prevent the subsurface of the asphalt from being washed away and having a decreased stability.

However, if the asphalt has no t been maintained properly, and the subsurface of the asphalt begins to deteriorate, traffic or any other load over the asphalt will have a tendency to crack the asphalt or weaken the asphalt to a point where cracks are easily formed.

Seams formed in the asphalt laying process may constitute another problem. Due to freezing, temperature change, or excess water allowed through the seams as well as other weather phenomena, the seam may eventually (within a year or two), depending on the sub-base, open up and leave a crack in the asphalt which usually runs along the seam. If the crack in the seam is not sealed within a reasonable period of time, water (from rain, snow, and other precipitation) may find its way underneath the asphalt between the layers of the asphalt. Changes in temperature, i.e., intermittent freezing and thawing, destruct the asphalt frames which also advances the deterioration process of the asphalt.

It is a known practice to fill cracks with sealers to repair the cracks in order to prevent further deterioration of the asphalt. Products such as commercially available rubberized asphalt, silicone rubber, cold tar, PVC, and neoprene have been used successfully in the repair of cracks in pavements. The selection of a proper sealer is contingent on the type of crack to be sealed and the end result desired.

Among the many techniques for sealing cracks in pavement two main methods have been typically used. One of the commercially used methods is a hot pour crack filling, where a sealing compound is heated and melted from a relatively solid brick state into a liquid state and maintained in a container with an oil jacket to insulate against heat loss. Being in a liquid stage the sealer is pumped into the crack through a hose and is applied around the crack as well as over the crack area. The machines for applying sealant to the crack using the hot pour crack filling method are relatively expensive, with the cost possibly ranging from $5,000.00 to $25,000.00. The process is extremely time consuming, because it takes about an hour to an hour and a half to heat the block of sealer to transform it into a liquid form, and then takes several hours to cool the sealer applied to the crack.

Another method of applying the crack sealer is what is referred to as a cold pour crack filling. According to this method, which is less expensive than the hot pour crack filling, the sealant is pumped out of 55 gallon drums and applied to the crack through a hose. Afterwards, the sealant is typically squeegeed by a worker on the job site.

However, use of a 55 gallon drum on any one job, presents a serious problem. Once the 55 gallon drum is opened and exposed to the air, the surface of the material in the drum begins to solidify. The cold pour sealant is a water-based material, in which water dissipates and dries upon exposure to the air, thus the process of hardening and thickening of the cold pour sealant is rapid. The sealant from the 55 gallon drum usually is pumped to a hopper, from which the sealant is applied to the crack.

However, the process of quick solidification of the sealant when the sealant hardens means that time flexibility is diminished. Additionally, if the sealant has dried in the hopper, it is difficult and time consuming to clean the hopper for further use. Usually, cleaning of the typical cold pour machine takes about an hour, and results in significant lost time in the overall process.

In order to obviate this problem some companies producing sealants, fill the sealant in five gallon plastic buckets, which are covered to prevent hardening of the sealant within the bucket.

Crack sealing machines come in a variety of different styles, types, designs, and dollar factors. For example, a crack sealer machine, described in U.S. Pat. No. 4,653,424, includes a support frame, a tank for holding a crack filling medium, a squeegee, and a handle regulating the squeegee and the flow of cracking filling medium from the tank. As described above, with respect to cold pour crack filling, sealant is loaded into the tank, which forms a part of the machine, and is inconvenient with respect to time lost for cleansing and washing of the hardened sealant left after the job is done.

Another machine for dispensing sealant into cracks in pavement, described in U.S. Pat. No. 4,575,279, includes a container mounted on a movable frame. The container has a dispensing opening in a bottom wall and a valve assembly in the container itself to control flow of sealant from the container. A roller and squeegee are mounted under the container for spreading the material after it has been dispensed. Similar to all other typical cold pour crack filling methods known in the art, the container after the job is done must be cleaned of the sealant which is inconvenient and time consuming.

Despite the existence of a variety of machines dispensing sealant to cracks in pavement, different techniques for maintaining the surface of pavement in proper shape, and many sealants available in the commercial marketplace, there has not yet been developed a machine and technique which would avoid time consuming cleaning of the hoppers in machines to prevent clogging of the system.

A machine for dispensing a sealant compound and technique for maintaining the surface of pavement spared of disadvantages of the prior art machines and techniques is thus a system which is needed in the industry to minimize labor requirements.

SUMMARY OF THE INVENTION

It is therefore an object of the present invention to provide a machine for dispensing a sealant compound into and around a crack in pavement which is convenient to use, lightweight, easy maneuverable, and in which no cleaning of a sealant container is needed.

It is a further object of the present invention to provide a machine for dispensing the sealing compound in which standard reasonably sized closed containers with sealing compound are used where the containers are discarded after the completion of a sealing job.

It is still a further object of the present invention to provide a machine for dispensing the sealant compound to a crack in the pavement wherein contact between the sealing compound within the disposable container of the sealing compound and the air is avoided.

It is still a further object of the present invention to provide a technique for dispensing a sealing compound to cracks in pavement in which a portable and self-contained machine carries a blower which blows dirt, leaves, and other debris from the crack to be filled prior to application of the sealing compound to the crack area. As a further object, the subject system allows the sealing compound to be dispensed from a disposable standard container which is discarded after the sealing compound is consumed.

In accordance with the present invention, a machine for dispensing a sealing compound is provided which includes a frame structure, a disposable container removably mounted to the frame structure containing a sealing compound pre-sealed into the container prior to the same being mounted on the frame structure. A discharge tube mounted on the frame structure serves to rupture the bottom of the disposable container brought into close engagement with a sharp edge of the discharge tube through which the sealing compound flows from the disposable container to the crack.

Preferably, the discharge tube is provided with an opening in proximity to the sharp edge, so that once the sharp edge of the discharge tube ruptures the bottom of the disposable container and penetrates the container, the sealing compound is accessed to a channel within the discharge tube through the opening. It is essential that the disposable container is a standard plastic bucket or other rupturable container with the sealing compound presealed therein prior to the container being mounted on the frame structure.

The disposable container is completely closed, thereby preventing the sealing compound from being inadvertently discharged from the container or brought into direct contact with the air or surrounding external environment. The opening ruptured in the bottom of the disposable container either does not allow open communication between the sealing compound and the air since it is closed by the discharge tube.

A control valve is provided within the discharge tube to control the flow of the sealing compound within the discharge tube.

Preferably, the frame structure includes a pair of rails, each having a front portion, handle portion, and intermediate portion therebetween. An axle transversely extends between the rails to which a pair of wheels are rotatably secured at two ends of the axle. The wheels are disposed close to the front portion of the rails. Adjacent to the axle of the wheels, a supporting bar extends between the rails for supporting a blower mounted thereonto to remove dirt, leaves and other debris from and around the crack prior to application of the sealing compound.

A first frame extends upwardly from the rails in crossing relationship with respect to the rails. The first frame is disposed between the supporting bar carrying the blower and the intermediate portion of the rails. The first frame includes a bottom bar, a top bar, and a pair of side bars erected between the bottom and the top bars. A lever handle is pivotally secured at one end thereof to the top bar of the first frame. The lever handle is translatable between a raised and lowered position. In the lower position, the lever handle presses the disposable container from vertically into closed engagement between the bottom of the disposable container and the sharp end of the discharge tube so that the sharp edge of the discharge tube ruptures the bottom of the disposable container and protrudes into the container in fluid communication with the sealing compound therewithin.

A second frame extends upwardly from the rails in substantial parallel relationship with the first frame. The second frame is disposed between the first frame and the intermediate portion of the rails of the frame structure. The second frame preferably includes a base beam extending transversely between the rails and a pair of side rods erected from the base beam in spaced apart relationship therebetween. The discharge tube extends through the base beam between the side rods of the second frame.

A pair of lower rods extend downwardly from the base beam of the second frame beneath the rails in order to carry a squeegee thereon. The squeegee preferably includes a box member having side walls forming a top and bottom opening and squeegee member attached to lower edges of the side walls of the box member. The top and bottom opening of the box members are aligned with the discharge end of the discharge tube, so that the sealing compound flows from the discharge tube into the box member and then is aligned and uniformly spread over the area of application by the squeegee member. The squeegee member is capable of oscillating around an axis supported at the end of the lower rod.

It is important that a pair of supporting beams extend between side rods of the second frame and the handle portion of the rails adapted to support the disposable container thereon. A locking member is provided to maintain the lever handle in lowered position for pressing the disposable container down into engagement with the discharge tube during the job being performed. The locking member includes a bar fastened to one of the supporting beams which terminates in a hook-like portion which is in engagement with the lever handle and maintains it in the lowered position.

Preferably the valve within the discharge tube is a valve capable of being in open and closed position. The valve is controlled by a grip trigger disposed at the handle portion of one of the rails which is manually actuated for controlling the valve.

The present invention additionally presents a method of dispensing a sealing compound to a crack in pavement according to which a machine is provided having a frame structure and a discharge tube secured to the frame structure. A disposable, completely closed container containing a sealing compound presealed into the container is removably mounted onto the frame structure and brought into closed engagement with the sharp end of the discharge tube. An opening in the bottom of the disposable container is formed.

The machine is advanced to the area of application of the sealing compound where dirt, debris and leaves are blown from and around the crack. A valve is opened within the discharge tube to allow the flow of the sealing compound from the disposable container to the area of application. After the job has been completed and the sealing compound consumed, the disposable container is dismounted from the frame structure and discarded whereby any unwanted and lost time actions for cleaning the container are avoided thereby providing a convenient, simple, and less time and labor intensive technique for sealing cracks in pavement.

These and other novel features and advantages of this invention will be fully understood from the following detailed description of the accompanying Drawings.

DETAILED DESCRIPTION OF THE PREFERRED EMBODIMENT

Figure 1:
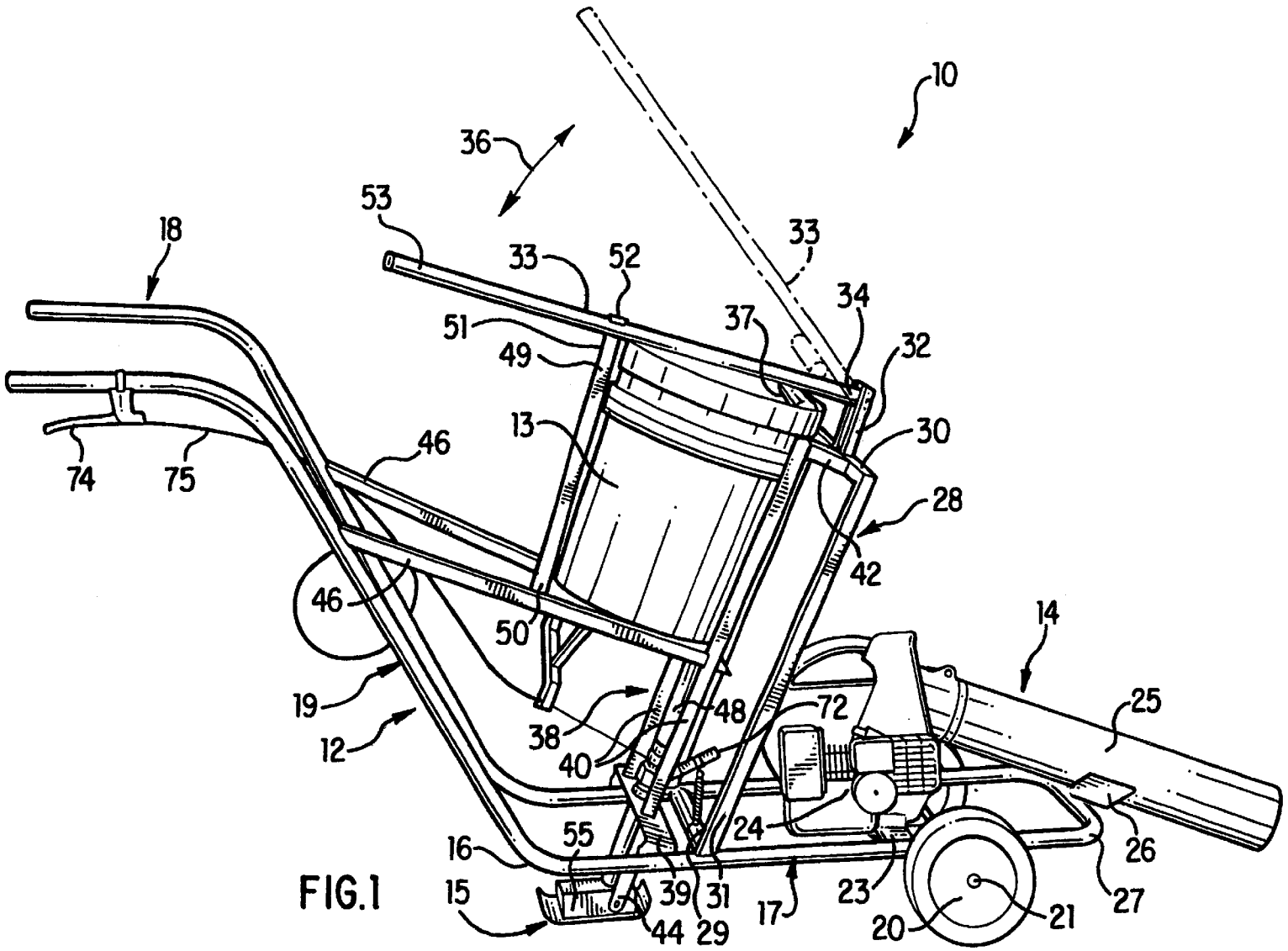
FIG. 1 is a perspective view of the sealing machine for dispensing a sealing compound of the present invention.
Figure 2:
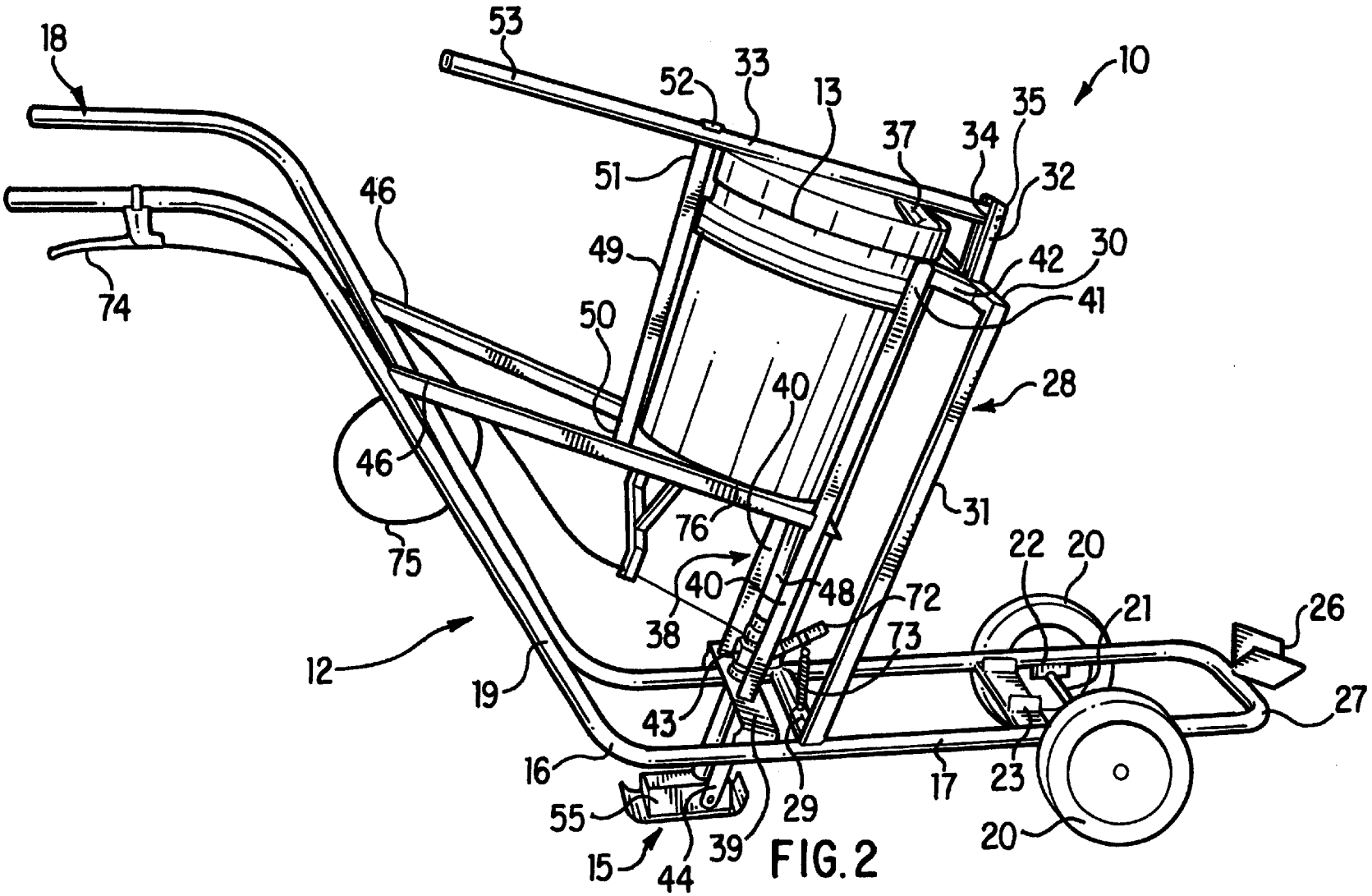
FIG. 2 is a perspective view of the machine for dispensing a sealing compound of the present invention showing a lever handle pressing a disposable container down onto the frame.
Figure 3:
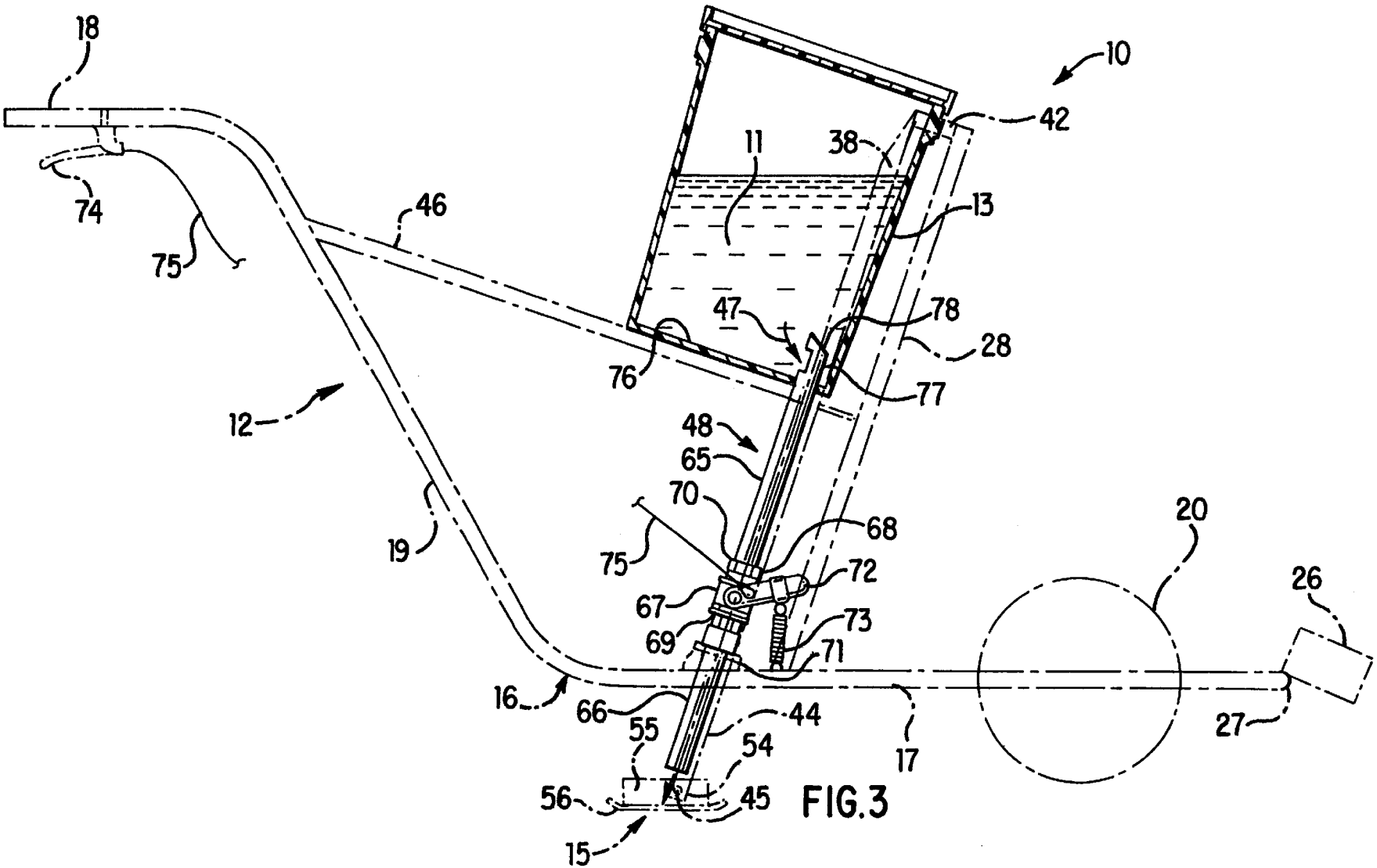
FIG. 3 is an elevational cross-section view of the sealing machine for dispensing a sealing compound of the present invention showing the discharge tube protruding into the chamber of the disposable container and providing a path for the sealing compound from the disposable container to the area of application.

Referring now to FIGS. 1–3, a sealing or crack sealing machine 10 for dispensing a sealing compound 11 is provided which includes a frame structure 12 on which a disposable container 13 is removably mounted to supply the sealing compound needed in the process of crack sealing. The disposable container 13 is a standard, preferably 5 gallon plastic bucket, commercially available and manufactured by many companies including Unique Paving Materials Corporation, Cleveland, Ohio, Genstar, Baltimore, Md., and others. The disposable container 13 is removed from the sealing machine 10 and discarded after the sealing compound is consumed and a paticular job is completed.

The machine 10 for dispensing a sealing compound, further includes a commercially available fan or blower 14 attached to the frame structure 12 for cleaning debris, dirt, and leaves from the crack to be filled.

The machine 10 is further provided with squeegee 15 supported beneath the frame structure 12.

As shown in FIGS. 1–3, the frame structure 12 of the machine 10 of the present invention includes a pair of rails 16 extending in spaced apart parallel relationship each with respect to the other. Each rail has a front portion 17, a handle portion 18, and an intermediate portion 19 integrally connecting the front portion 17 and the handle portion 18 of the rails 16.

The rails 16 are supported on a wheel and axle assembly which includes a pair of wheels 20 mounted on opposite ends of an axle 21 which is attached to the rails 16 by means of brackets 22. The axle 21 extends transversely between the rails 16.

As best shown in FIG. 2, a supporting bar 23 extends transversely between the rails 16 at the front portion 17 thereof to support the blower structure 14, best shown in FIG. 1. The blower structure 14 is preferably a leaf type blower powered by gasoline engine 24 running the blower 25 supported in position on the frame structure 12 by a V-shaped member 26 at the front end 27 of the rails 16.

A first frame 28 extends upwardly from the rails 16 in crossing relationship with the rails. The frame 28 is disposed between the supporting bar carrying the blower structure 14 and the intermediate portion 19 of the rails 16.

The frame 28 includes a bottom bar 29, a top bar 30, and a pair of side bars 31 extending from the bottom bars 29 and extending between the bottom and top bars 29 and 30, respectively. An elevation member 32 extends upwardly substantially in the center of the top bar 30 of the frame 28.

A lever handle 33 is pivotally secured to the elevation member 32 at the end 34 of the lever handle 33. The lever handle 33 may pivot around the axis 35 and can translate from the raised position, shown in phantom lines, and lowered position as shown by arrows 36. In proximity to the end 34, the lever handle 33 is provided with a transversal member 37, the function of which will be described in following paragraphs.

A second frame 38 extends upwardly from the rails 16 in crossing relationship to them. The frame 38 is disposed between the frame 28 and the intermediate portion 19 of the rails 16. The frame 38 includes a base beam 39 extending transversely between the rails 16 and a pair of side rods 40 extending from the base beam 39 in spaced apart relationship therebetween. At the top ends 41 of the side rods 40, the side rods 40 are fastened to the top bar 30 of the frame 28 by beams 42. The base beam 39 is provided with an opening 43 formed substantially in a center portion thereof (the function of this opening will be described in following paragraphs).

A pair of lower rods 44 are secured preferably by welding, to the bottom of the base beam 39 and extend downwardly therefrom beneath the rails 16. An axle 45 stands between the lower rods 44 in proximity to the lowermost ends thereof.

The squeegee structure 15 is secured to the lower rods 44 and may oscillate around the squeegee axle 45. A pair of supporting beams 46 extend between side rods 40 and intermediate portions 19 of the rails 16. The supporting beams 46, in combination with the side rods 40 of the frame 38, form a structure adapted for supporting the disposable container 13 thereon.

As it is best shown in FIGS. 1–3, the supporting beam 46 side rods 40 structure is tilted towards the front end of the rails 16 in order that the disposable container 13 mounted on the supporting beam 46 leans against the side rods 40 thereby maintaining a stable position. As best shown in FIG. 3, the sealing compound 11 within the tilted disposable container 13, forms a higher pressure liquid sealing compound 11 above and around the opening 47 in the discharge tube member 48. The higher pressure facilitates passage of the sealing compound 11 into the discharge tube member 48. In addition, the tilted position of the disposable container 13, provides substantially for complete consumption of the sealing compound 11 in the disposable container 13 due to a high level of sealing compound 11 above and around the opening 47 within the discharge tube member 48.

A locking member 49 is secured, preferably by welding, at the end 50 thereof to one of the supporting beams 46. Another end 51 of the locking member 49 is provided with a hook-like portion 52 intended for locking the lever handle 33 in a lowered and engaging position by means of engaging the hook-like portion 52 of the locking member 49 with the end 53 of the lever handle 33 to keep the disposable container 13 captured in a lowered or downward position as shown in FIG. 3.

Figure 4:
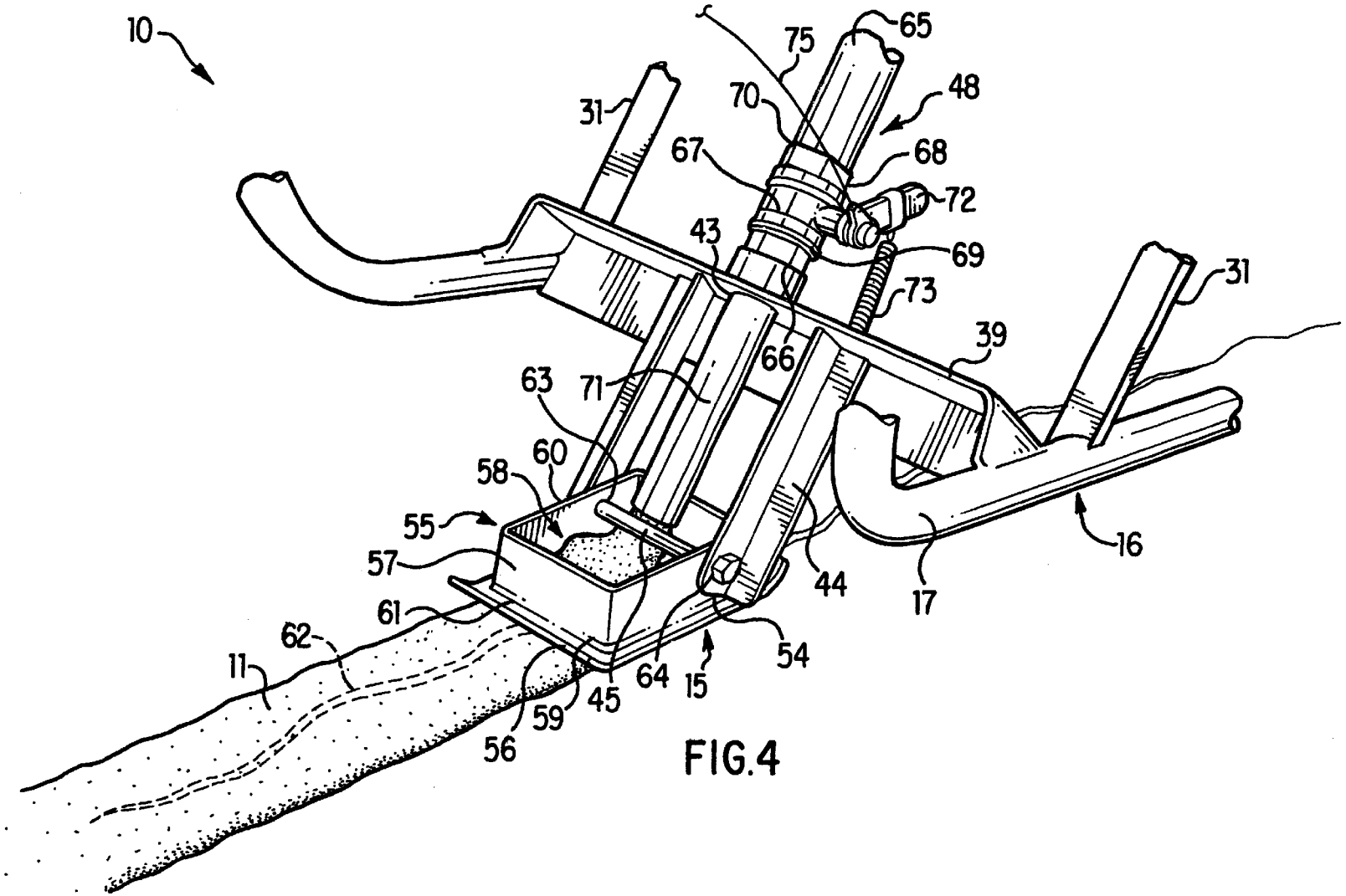
FIG. 4 is a partial cut-away perspective view of the machine of the present invention showing the squeegee means uniformly distributing the sealing compound over the crack to be filled.

As described above, the lower rods 44 support the squeegee structure 15 at the lowermost ends 54 thereof. The squeegee structure 15 includes a box member 55, best shown in FIG. 4, and squeegee member 56. The box member 55 has side walls 57 forming a closed structure and configured in such a way as to form a top opening 58 and a bottom opening 59 at the upper edge 60 and lower edge 61 of the side walls 57. The squeegee member 56, is mounted at the lower edge 61 of the side walls 57 so that when the squeegee structure 15 is moved along with the machine 10, the squeegee member 56 evenly distributes the sealing compound 11 dispensed over the crack 62, as best shown in FIG. 4.

Two opposite side walls 57 have openings formed therethrough to allow the axle 45 to protrude therethrough and through respective openings 64 in the lowermost ends 54 of the lower rods 44. The squeegee structure, particularly the box member 55, therefore, is capable of rotational displacement about the axle 45. In this manner, the squeegee member 56 is permitted a number of degrees of displacement freedom, thereby adapting the squeegee structure 15 to a wide variety of profiles of the surface of the pavement to be sealed.

As best shown in FIG. 3, the discharge tube member 48 includes an upper tube 65 and a lower tube 66 assembled with the upper tube 65 through a valve containing member 67 disposed between the upper tube 65 and the lower tube 66. The valve containing member 67 is well-known to those skilled in the art and has internal threads or external threads (not shown) at the edges 68 and 69 thereof for coupling the valve containing member 67 in threading engagement with the upper tube 65 and the lower tube 66 at the respective edges 70 and 71 thereof. The valve containing member 67 contains a valve, not shown in the Drawings, for regulating a flow of the sealing compound 11 through the discharge tube member 48 to the area of application.

Preferably, the one-way or check valve is a ball valve, well-known to those skilled in the art, having a ball portion and a stem connected to the ball portion. The valve containing member 67 has a membrane therein disposed transversely to the longitudinal axis of the valve containing member.

This membrane has an opening with the stem of the ball valve inserted thereinto. In order to dispense the sealing compound 11 through the discharge tube member 48, the stem of the ball valve should be removed from the opening in the membrane disposed within the valve containing member 67.

In order to control opening and closing of the ball valve, the valve containing member 67 is provided with a valve lever 72, best shown in FIG. 4. The valve lever 72, is biased in downward position by a spring 73 coupled by one end thereof to the valve lever 72 and by another end thereof to the bottom bar 29 of the frame 28.

In order to control the flow of the sealing compound through the discharge tube member 48, the handle portion 18 of the rails 16 is provided with a trigger grip connected to the valve lever 72 through cable 75. When a user manually actuates the trigger grip 74, pressing the grip 74 towards the handle portion 18 of the rails 16, the cable 75 pulls the end of the valve lever 72 upwardly overcoming the forces created by the spring 73 which causes the stem of the ball valve within the valve containing member 67 to move upwardly from the opening within the membrane within the valve containing member 67, thereby permitting the sealing compound 11 to pass through the opening in the membrane and out of the disposable container 13.

Once the trigger grip 74 is freed, i.e., is not manually actuated, the cable 75 stops pulling the valve lever 72 upwardly, thus permitting the spring 73 to pull the valve lever 72 downward, thereby causing the stem of the ball valve again to protrude into the opening in the valve containing member 67, thus stopping the flow of the sealing compound 11 through the discharge tube member 48.

As discussed above, the disposable container 13 is a standard plastic bucket produced by several manufacturers such as for example Unique Paving Materials Corporation in Cleveland, Ohio, or Genstar, in Baltimore, Md., and includes five gallons of sealing compound such as a compound manufactured under the name Kold Flo, or any other cold pour crack sealer commonly sold to seal the surface of cracked pavement.

The bucket 13 is also commercially available and is mounted onto the frame structure 12 best shown in FIGS. 1–3, particularly on the pair of the supporting beams 46 thereof. The lever handle 33 is then translated into the lowered position, thereby pressing the container 13 downwardly, and is locked in the lowered position by means of the locking member 49. Being captured in the lowermost position, the container 13, specifically the bottom 76 thereof is brought into the intimate contact with the upper portion 77 of the discharge tube member 48 which is provided with a sharp end 78 rupturing the bottom 76 of the container 13 and extending into the interior of the container 13.

An opening 79 is formed by the upper portion 77 of the discharge tube members 48 in close proximity to the sharp end 78 thereof, so that once the upper portion 77 of the discharge tube member 48 is immersed into the sealing compound 11 within the container 13, a fluid communication path is formed for the sealing compound 11 between the interior of the disposable container 13 and the area of application of the sealing compound through the channel (not shown) within the discharge tube member 48. This allows the sealing compound 11 to flow from the container 13 to the crack 62 as shown in FIG. 4.

Flow of compound passes from the top and bottom openings 58 and 59, respectively formed in the box member 55 of the squeegee structure 15. Once the fluid communication between the disposable container 13 and the discharge tube member 48 has been formed, the machine 10 is advanced towards the area of application of the sealing compound by means of pushing the frame structure 12 towards the desired location by means of manipulating the handle portion 18 of the rails 16.

The movement of the machine 10 is assisted by a pair of wheels 20, described in previous paragraphs. Being brought to the desired position, the blower 25 installed on the frame structure 12 may be activated and the machine is moved along the crack to be sealed with the sealing compound 11, thereby cleaning the crack and area in proximity thereto from debris, leaves, and other unwanted dirt. Simultaneous to the advancement of the machine along the crack and cleaning the area of the sealant application, the user manually controls the trigger grip 74 to control flow of the sealing compound 11 to the crack.

The sealant flows through the discharge tube member 48 into the squeegee box 55 and is evenly spread over the crack and nearmost areas by the squeegee member 56. When the job is completed, and the crack is sealed with the sealing compound, the machine 10 is removed from the area of application and the sealing compound dries. As the machine moves backward and forward, the sealing compound 11 is spread by means of the squeegee structure 15.

Thus, it is seen that the present invention provides a unique and novel machine for dispensing and spreading sealing compound in convenient and efficient manner.

After the crack is sealed, the blower is turned off, the lever handle 33 is disengaged from the locking member 49 and is translated into its upper position. The disposable container 13 is removed from the frame structure 12 and is discarded. The discharge tube member 48 is dismounted and the valve containing member 67 is cleaned with kerosene. It is to be understood that this is the only portion of the structure which must be cleaned after the job is completed.

As it is clear from the above disclosure, the machine for dispensing a sealing compound provides for a convenient and simple to use means for pavement maintenance which avoids labor and time consuming cleaning of tanks of the typical systems for crack sealing.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A machine for dispensing a sealing compound at an area of application, comprising:

(a) a frame structure;

(b) a disposable container removably mounted on said frame structure;

(c) a sealing compound pre-filled into said disposable container prior to mounting said disposable container on said frame structure, said disposable container having walls forming a closed chamber containing said sealing compound whereby said sealing compound is prevented from being inadvertent discharge from said disposable container and from being brought into contact in surrounding atmosphere;

(d) discharge means on said frame structure for puncturing said disposable container, said discharge means including a tube member provided with a sharp edge at first end thereof and having walls forming an opening in proximity to said sharp edge, said tube member having a second end for discharging said sealing compound;

(e) a pressing member secured to said frame structure for bringing said disposable container into engagement with said sharp edge of said tube member of said discharge means thereby forming a fluid communication path for said sealing compound between interior of said closed chamber of said disposable container and said second end of said tube member of said discharge means; and, (f) squeegee means pivotally coupled to said frame structure for spreading said sealing compound into the area of application, said squeegee means including a box member having side walls forming respective top and bottom openings at upper and lower edges of said side walls, and a squeegee member attached to said lower edges of said side walls of said box member, said top opening of said box member being aligned with said second end of said tube member of said discharge means for receiving said sealing compound in said box member and applying said sealing compound to the area of application.

2. The machine as recited in claim 1 further comprising a locking member coupled to said frame structure on one end thereof and being releasably engageable with said pressing member for releasably capturing said disposable container between said frame structure and said pressing member.

3. A machine for dispensing a sealing compound at an area of application, comprising:

(a) a frame structure;

(b) a disposable container removably mounted on said frame structure;

(c) a sealing compound pre-filled into said disposable container prior to mounting said disposable container on said frame structure, said disposable container having walls forming a closed chamber containing said sealing compound whereby said sealing compound is prevented from being inadvertent discharge from said disposable container and from being brought into contact in surrounding atmosphere;

(d) discharge means on said frame structure for puncturing said disposable container, said discharge means including a tube member provided with a sharp edge at first end thereof and having walls forming an opening in proximity to said sharp edge; and, (e) a pressing member secured to said frame structure for bringing said disposable container into engagement with said sharp edge of said tube member of said discharge means thereby forming a fluid communication path for said sealing compound between interior of said closed chamber of said disposable container and said area of application of said sealing compound through said tube member of said discharge means;

said frame structure including:

a pair of rails extending in spaced apart substantially parallel relationship therebetween, said rails having a front portion, a handle portion, and an intermediate portion connecting said front and handle portions;

an axle transversely extending between said rails at said front portion thereof, a pair of wheels being rotatably secured to said axle at two ends thereof;

a supporting bar transversely extending between said rails at said front portion thereof, said supporting bar being disposed between said axle and said intermediate portion of said rails, a blower being mounted onto said supporting bar;

a first frame extending upwardly from said rails in crossing relationship therewith, said first frame being disposed between said supporting bar and said intermediate portion of said rails;

said first frame including a bottom bar, a top bar, and a pair of side bars extending between said bottom and top bars at respective ends thereof, said pressing member in the form of a lever handle being pivotally secured at said top bar at one end of said lever handle, said lever handle being translatable between raised and lowered positions thereof;

a second frame extending upwardly from said rails in crossing relationship therewith, said second frame being disposed between said first frame and said intermediate portion of said rails, said second frame including a base beam extending transversely between said rails and said pair of side rods erecting from said base beam in spaced apart relationship therebetween, said tube member of said discharge means extending through said base beam of said second frame between said side rods thereof;

a pair of lower rods extending downwardly from said base beam of said second frame beneath said rails, a squeegee means being supported by said lower rods in pivoting arrangement therewith;

a pair of supporting beams, each supporting beam extending between a respective one of said side rods of said second frame and said intermediate portion of a respective one of said rails;

said disposable container being mounted on said pair of supporting beams in inclined relation with said side rods of said second frame; and, a locking member including a bar fastened at a lower end thereof to a respective one of said supporting beams, and provided with a hook portion at an upper end thereof, said lever handle being locked in said lowered position thereof by means of latching said lever handle at a free end thereof by said hook portion of said locking member.

4. A method of dispensing a sealing compound at an area of application, comprising the steps of:

providing a frame structure;

securing a tube member to said frame structure, said tube member having a sharp end at an upper portion thereof;

mounting on said frame structure a completely closed disposable container, said container being pre-filled with a sealing compound;

displacing said disposable container into engagement with said sharp end of said tube marker, thereby forcing said sharp end to rupture said disposable container at a predetermined location and forming a fluid flow path for said sealing compound from said disposable container through said tube;

providing a controllable valve within said tube member;

providing a box member pivotally coupled to said frame structure, said box member having upper and lower openings respectively formed in upper and lower sides thereof and a squeegee member attached to said lower side, said upper opening of said box member being aligned with a lower end of said tube member for directing said sealing compound into said box member;

advancing said frame structure carrying said disposable container towards the area of application of said sealing compound;

opening said valve to allow discharge of said sealing compound into said box member and applying said sealing compound to the area of application through the lower opening of the box member and spread by said squeegee member; and dismounting said disposable container from said frame structure and discarding the same once said sealing compound has been consumed.

* * * * *